United States Patent [19]

Hasegawa

[11] 4,276,993

[45] Jul. 7, 1981

[54] EASY-OPENING CONTAINER WITH NON-DETACH TAB

[75] Inventor: Gary K. Hasegawa, Chicago, Ill.

[73] Assignee: The Continental Group, Inc., Stamford, Conn.

[21] Appl. No.: 83,450

[22] Filed: Oct. 10, 1979

[51] Int. Cl.[3] ..... B65D 17/34

[52] U.S. Cl. ..... 220/269

[58] Field of Search ..... 220/269-273

[56] References Cited

U.S. PATENT DOCUMENTS

| | | | |
|---|---|---|---|
| 3,394,837 | 7/1968 | Hansen et al. | 220/270 |
| 4,024,981 | 5/1977 | Brown | 220/269 |

*Primary Examiner*—George T. Hall

*Attorney, Agent, or Firm*—John J. Kowalik

[57] ABSTRACT

An easy opening container having an end panel with push-in section and a non-detachable tab secured to the end panel and formed with a uniquely shaped lift end portion having an aperture therein sufficient to admit the nodes of the user's grasping fingers but of a size less than would permit inserting a finger therethrough and the novel construction of the tab and presenting a finger placement limiting edge which is adapted to position the fingers of the user such as to prevent the user's fingernail from being broken in attempting to open said container.

10 Claims, 4 Drawing Figures

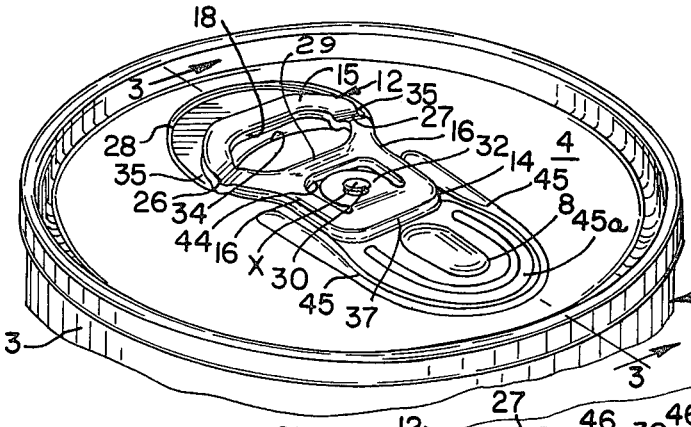
FIG. 1
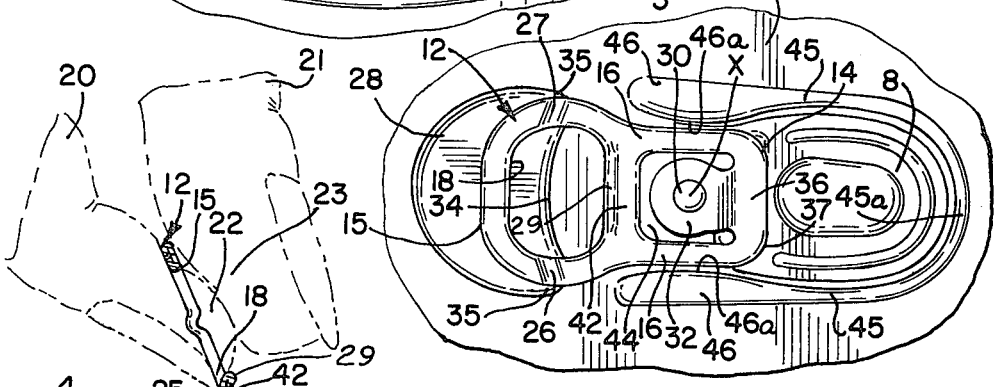
FIG. 2
FIG. 4
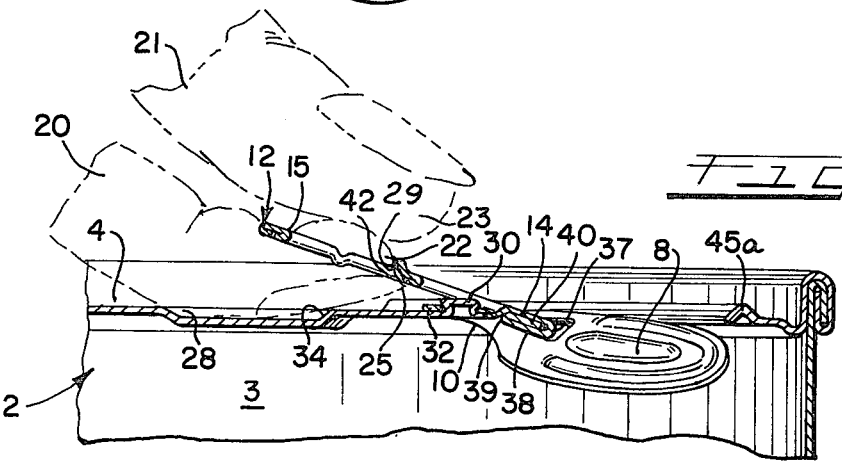
FIG. 3

EASY-OPENING CONTAINER WITH NON-DETACH TAB

DISCUSSION OF THE INVENTION

The invention appertains to an easy opening container and, more specifically, to a novel tab and can end structure affording improved grasp and lift characteristics for the tab and in which at least some of the parts also function to restrain the tab fro turning about the securing rivet to an inoperative position.

DISCUSSION OF THE PRIOR ART

The prior art is replete with various tab antirotation devices and depressions beneath the lift end of the tab to facilitate grasping of the tab. These devices primarily each serve their own individual uses and are not coordinated into an effective multi-use purpose.

SUMMARY OF THE INVENTION

The primary object of the invention is to provide for non-detachable opening device, in a lever tab for opening a score portion of a container end panel, a ring-shaped lift portion having an opening therein of a size such as would not admit therethrough a typical teenager's or adult's finger but would allow such person to grasp the ring between the thumb and forefinger with the nodes thereof touching, to improve the person's purchase of the tab but preventing the person from gaining an adequate hold on the tab so as to tear it off the can end.

The invention also comprehends positioning the tab antirotation component in a location where it will indent the node of one of the fingers grasping the lift end of the tab, thus further improving the purchase.

A further object is to provide as part of the tab antirotation device, a bead on the can end positioned about the openable tear portion and having a pair of legs flanking the nose portion of the tab and serving as guides for the tab when it is being lifted.

Another object is to provide a hole in the tab lift end of such shape and size as will prevent entry of the user's fingers therethrough and in the initial lifting phase and limits the forward portion of the fingers and thus serves to so position a user's fingers to preclude nail breakage.

These and other objects and advantages inherent in the invention will become more apparent from the specification and the drawings wherein:

FIG. 1 is a top perspective view of a container embodying the invention;

FIG. 2 is a fragmentary enlarged top plan view;

FIG. 3 is a cross-sectional view taken substantially on line 3—3 of FIG. 1 showing an initial phase of opening of the container; and FIG. 4 is the same sectional view as FIG. 3, but showing a further opening phase.

DESCRIPTION OF THE INVENTION

The invention is shown in a container 2 having a body 3 with a closed bottom (not shown) and a top end panel 4 seamed to the body.

The panel 2 is scored at 5 which defines an openable segment or disk 8 and a hinge 10 which holds the disk connected to the end panel after it is pushed into the container by the lever or tab 12.

The tab 12 is made of a single piece of sheet metal, preferably aluminum and comprises a nose portion 14 at one end and a lift portion 15 at its other end. The tab has a pair of legs 16,16 extending from the nose portion to the lift portion. The legs are C-shaped in cross-section. The lift portion is shaped in the form of a ring having a finger-node admitting hole 18, preferably of rectangular shape although it may be circular or oval. It is of utmost importance, however, that the length or major axis of hole 18 must be transverse to the length of the tab and the hole size must only be large enough to admit the nose of the user but not the finger. Thus, the user's forefinger designated at 20 and thumb 21 grasp the tab therebetween with their nodes 22,23 touching. Thus, the user obtains a good purchase on the tab, but because the user cannot put his finger through the ring hole, he cannot get such hold that will enable him to tear the tab off the can end. Furthermore, the small ring hole insures that the user cannot push the finger node through the hole and break the fingernail 25, the nail assuming the positions shown in FIGS. 3 and 4 and the front end of the finger node resting against a finger placement limiting stop 29. This stop may be only the thickness of the metal of the cross-bridge 42 which provides a sufficiently wide surface to form said stop.

As best seen in FIGS. 3 and 4, the ring position of the tab comprises an anti-rotation device in the form of downwardly offset shaped projections 26,27 which enter into a well 28.

The projections 26,27 each ride along a curved surface on the front edge 34 of the depression 28 and at their remote ends about the side edges 35 of the U-shaped half moon section thus inhibiting rotation of the tab about the rivet 30. These projections 26,27 are also grasped by the finger node of the user and depress the same to increase purchase. They also inhibit the finger from sliding forward and thus joining the user's nail against the rear edge 35 of the lug 32 which at its forward end is connected to the transverse top wall portion 36 of the nose.

The front end of wall 36 terminates in a front edge 37 which is normal to the longitudinal axis of the tab as represented by line 3—3 of FIG. 1. Wall 36 is continued as a folded under wall portion 38 which is continued to a curved rear fold edge portion 39 which seats against the underside of the front end of the lug in its bend region. The portion 39 is connected to a forwardly turned strip 40 which lies flat and parallel to the top and bottom walls 36, 38 therebetween and with said walls strengthens the non portion. The intermediate portion of the tab is defined by a cross-bridge element 42 which forms the forward portion of the node hole and the rear portion of the well 44 in which the lug 32 is situated. The cross-bar or cross-bridge 42 has its rear edge flange 49 folded so as to provide a dependent stop for the node of the thumb and thus prevents the node from being positioned in a location such as will cause the fingernail of the user to enter into the space proximate to the rivet and cause nail breakage.

The score 5 is surrounded by a U-shaped ridge or bead 45 which has a pair of legs 45, 45 which at those teardrop shaped lug portions 46, 46 closely flanking the nose and intermediate portion 47 of the tab. The legs 45, 45 have convex inner edge portions, the crests of 46 of which closely approach the sides 47, 47 of the tab in an area between the nose and intermediate portion of the tab ahead of the rivet. Thus when the tab is raised, these points 46, 46 act as lateral guide contacts with the tab sides and prevent rotation of the tab during the time it is lifted or pressed back against the top 48 of the panel.

It will be noted that the locking humps also serve as a guide for the finger node during lifting of the tab such that the lifted position of the tab the finger is prevented from slipping back and thus jamming the fingernail against the underside of the bridge portion of the tab.

Thus a novel and effective control feature has been incorporated into the tab which prevents nail breakage but also serves to hold the finger from slipping back. The functioning antirotation device when lifted out of the pocket or depression being taken over by the side guide portions 46, 46 which may abut the side edges of the tab without binding.

What is claimed is:

1. An easy opening container having an end panel with a scored area defining a closure disk adapted to be severed from said panel and pushed into the container;

a tab having a nose portion at one end overlying said disk, an ear secured to said panel in an area spaced from said disk and a lift portion at the opposite end of the tab;

said lift portion having an aperture therein dimensioned to only admit the nodes of the user's finger grasping said lift portion; and finger-placement-limiting means on the tab between said aperture and the area of securement of said tab to said end panel.

2. The invention according to claim 1 and said limiting means comprising a cross-bar defining an edge of said opening adjacent to said area of securement.

3. The invention according to claim 1 and said limiting means comprising a projection on the underside of said tab at the edge of said aperture proximate said securement area.

4. The invention according to claim 1 and said tab comprising a lug and said securement means comprising a rivet extending through said lip.

5. The invention according to claim 1 and said means comprising a portion of said tab at said opening shaped to extend a distance beyond the normal thickness of said lift portion.

6. A non-detachable tab for use in an easy opening container comprising a sheet metal structure having a body intermediate its ends, means on the body for permanently attaching the tab to the container, a nose at one end and a lift portion at the other end, said lift portion having an aperture therethrough sized to admit the nodes of the user's fingers but insufficient to pass the user's fingers therethrough, said lift portion having a ring-like peripheral section defining said aperture, and finger-engagable abutment means on said section for holding the user's finger from slipping with respect to said tab.

7. A tab for use in an easy opening container comprising a sheet metal structure having a body intermediate its ends, a nose at one end and a lift portion at the other end, said lift portion having an aperture therethrough sized to admit the nodes of the user's fingers but insufficient to pass the user's fingers therethrough, and means formed on the tab between the lift end portion and the body portion for limiting the insertion of the user's fingers beyond a predetermined area.

8. The invention according to claim 7 and said tab having anti-rotation means depressed below the underside of the tab.

9. The invention according to claim 8 and a container having a well for receiving said anti-rotation means and having an edge engageable therewith.

10. The invention according to claim 9 and said well and said anti-rotation means having a common radius of curvature, and said means on the body of the tab comprising a securing lug with a rivet-receiving hole therethrough.

* * * * *